US012384575B2

(12) United States Patent
Peccetti

(10) Patent No.: US 12,384,575 B2
(45) Date of Patent: Aug. 12, 2025

(54) METHOD FOR ADVANCING PRODUCTS ARRANGED CONSECUTIVELY IN AT LEAST ONE ROW WHICH ARE MOVED FORWARDS INTO A PACKAGING MACHINE

(71) Applicant: COLINES S.P.A., Novara (IT)

(72) Inventor: Francesco Peccetti, Novara (IT)

(73) Assignee: COLINES S.P.A., Novara (IT)

( * ) Notice: Subject to any disclaimer, the term of this patent is extended or adjusted under 35 U.S.C. 154(b) by 147 days.

(21) Appl. No.: 18/257,932

(22) PCT Filed: Dec. 18, 2020

(86) PCT No.: PCT/IB2020/062165

§ 371 (c)(1),
(2) Date: Jun. 16, 2023

(87) PCT Pub. No.: WO2022/130003

PCT Pub. Date: Jun. 23, 2022

(65) Prior Publication Data

US 2024/0043151 A1 Feb. 8, 2024

(51) Int. Cl.
*B65B 11/10* (2006.01)
*B65B 21/24* (2006.01)
(Continued)

(52) U.S. Cl.
CPC ..... *B65B 11/105* (2013.01); *B65B 21/245* (2013.01); *B65B 35/34* (2013.01); *B65B 11/58* (2013.01)

(58) Field of Classification Search
CPC ..... B65B 11/025; B65B 11/08; B65B 11/10; B65B 11/105; B65B 11/58; B65B 21/24; B65B 21/245; B65B 35/34
See application file for complete search history.

(56) References Cited

U.S. PATENT DOCUMENTS 3,782,070 A * 1/1974 Erlandson ..... B65B 9/06 83/326
4,050,220 A * 9/1977 Lancaster ..... B65B 61/06 53/550

(Continued)

FOREIGN PATENT DOCUMENTS

WO 2017137318 A1 8/2017
WO 2018073045 A1 4/2018

OTHER PUBLICATIONS

International Search Report and Written Opinion received for PCT Serial No. PCT/IB2020/062165, on Sep. 17, 2021, 10 pgs.

*Primary Examiner* — Anna K Kinsaul
*Assistant Examiner* — Himchan Song
(74) *Attorney, Agent, or Firm* — Merchant & Gould P.C.

(57) ABSTRACT

A method advances products arranged consecutively in at least one row which are moved forwards into a packaging machine to be wrapped in at least one stretch film. The method includes ordering and advancing the products arranged consecutively in at least one continuous row, followed by wrapping the products arranged consecutively in at least one continuous row in at least one stretch film. The products arranged consecutively in at least one continuous row and wrapped in the at least one stretch film are evacuated. In at least one of the steps, guides with a minimum friction coefficient are used for guiding and/or supporting the products arranged consecutively in at least one continuous row and/or wrapped in the at least one stretch film.

10 Claims, 3 Drawing Sheets

(51) Int. Cl.
*B65B 35/34* (2006.01)
*B65B 11/58* (2006.01)

(56) References Cited

U.S. PATENT DOCUMENTS

| | | | | | |
|---|---|---|---|---|---|
| 4,218,863 | A * | 8/1980 | Howard | B65B 61/08 | 198/377.01 |
| 4,549,388 | A * | 10/1985 | Lancaster | B65B 51/225 | 53/210 |
| 4,953,336 | A * | 9/1990 | Lancaster, III | B65B 11/008 | 53/556 |
| 5,531,061 | A * | 7/1996 | Peterson | B65B 61/06 | 53/529 |
| 6,745,544 | B2 * | 6/2004 | Matsumoto | B65B 11/585 | 53/399 |
| 2008/0047232 | A1 * | 2/2008 | Kovacs | B65B 61/10 | 53/550 |
| 2019/0016488 | A1 * | 1/2019 | Peccetti | B65B 21/245 | |
| 2019/0023430 | A1 * | 1/2019 | Peccetti | B65B 61/10 | |
| 2019/0055044 | A1 * | 2/2019 | Peccetti | B65B 61/06 | |
| 2019/0241291 | A1 * | 8/2019 | Peccetti | B65B 35/44 | |
| 2024/0043151 | A1 * | 2/2024 | Peccetti | B65B 21/24 | |

* cited by examiner

METHOD FOR ADVANCING PRODUCTS ARRANGED CONSECUTIVELY IN AT LEAST ONE ROW WHICH ARE MOVED FORWARDS INTO A PACKAGING MACHINE

CROSS-REFERENCE TO RELATED APPLICATIONS

This application is a national stage of International Application No. PCT/IB2020/062165, filed on Dec. 18, 2020, which is incorporated herein by reference in its entirety.

TECHNICAL FIELD

The present invention relates to a method for advancing products arranged consecutively in at least one row to be packaged wrapped in at least one stretch film.

BACKGROUND

Products of various types, such as bottles, variously sized boxes, etc. in order to be transported and/or distributed in groups of two or more products, are currently packed and packaged for example in stretch film.

This packaging creates a series of operational problems both in packaging and in the formation of the single group of products or packaging, in particular, for example, in moving them for reaching the packaging.

There are in fact problems of stability of the products moving forwards and also problems connected with the forces to be applied to allow their correct advancement in the packaging phase.

It is in this step that the products, for example arranged in groups or continuously, are positioned within a film of plastic stretch material which is wrapped around them.

For their handling, rigid sustaining and containment supports, or conveyor belts or roller conveyors or mechanical guides are generally used, that keep them both arranged consecutively in one or more rows both before being wrapped and during wrapping and finally after wrapping in order not to damage the packaging.

For correctly effecting the packaging in bundles, it is obviously necessary to have a good repeatability of the various packaging phases, especially regardless of the friction conditions involved. There is in fact considerable contact friction between the wrapping film and the wrapping guides and between the containment guides and the products moving forwards, such as for example advancing bottles. The reciprocal friction conditions between these elements is variable depending on various parameters, such as the process speed or the ratio between the wrapping angle and the advancement percentage of the products.

As the frictional forces are generated by a contact force for a friction coefficient, it is necessary to ensure that the latter tends towards zero, so that as the contact forces vary physiologically over time, the friction conditions remain tending towards "zero".

SUMMARY OF THE INVENTION

The general objective of the present invention is to identify a method for advancing products into a packaging machine capable of solving the above-mentioned drawbacks of the prior art in an extremely simple, economical and particularly functional way.

A further objective of the present invention is to provide a method for advancing products arranged consecutively in at least one row and wrapped in at least one stretch film which are moved forwards into a packaging machine which eliminates the above-mentioned drawbacks of the known art.

Another objective of the present invention is to provide a method for advancing products in a packaging machine that is simple to apply and independent of the products involved.

Yet another objective of the present invention is to provide a method for advancing products into a packaging machine that does not cause any deformation on the products being packaged.

The above-mentioned objectives are achieved by a method implemented and effected according to independent claim 1 and the following subordinate claims.

BRIEF DESCRIPTION OF THE DRAWINGS

The structural and functional characteristics of the present invention and its advantages with respect to the known art will appear even more evident from the following description, referring to the attached schematic drawings, which show a non-limiting but purely illustrative implementation example of the invention itself.

In the drawings.

DETAILED DESCRIPTION

Figure 1A:
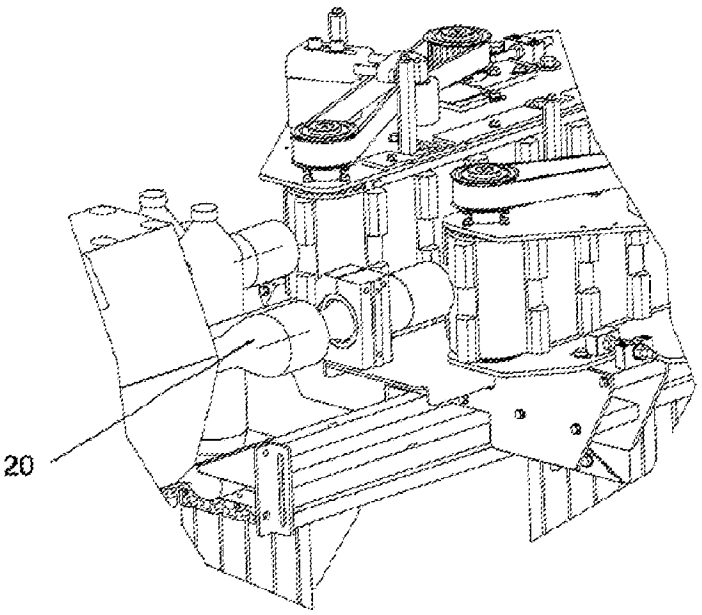
FIG. 1*a* is an enlarged detail of the machine of FIG. 1.

With reference to the illustrative and non-limiting figures, a section of a packaging machine of products is shown in which the method for advancing products according to the present invention is implemented:

Part of a packaging machine of products in stretch film fed in groups, such as bottles, boxes or other objects, or individually as a single product 11, is in fact shown.

It should be considered that upstream of this section of the machine, the individual products 11 can be arranged in order, for example in one or more rows, aligned consecutively and/or in adjacent rows.

Said products 11 must be moved forwards as far as a wrapping group 12 in which a stretch film 14 wraps at least one row of products 11.

The figures show, for example, two rows of products 11, such as bottles, carried forward towards the wrapping group 12 which in the example consists of a winding ring 15 on which a trolley 16 carrying a reel 17 of stretch film 14 is arranged.

The two rows of products 11 positioned adjacently move within guides arranged specifically for guiding and/or supporting said products 11 to be packaged.

Figure 1:
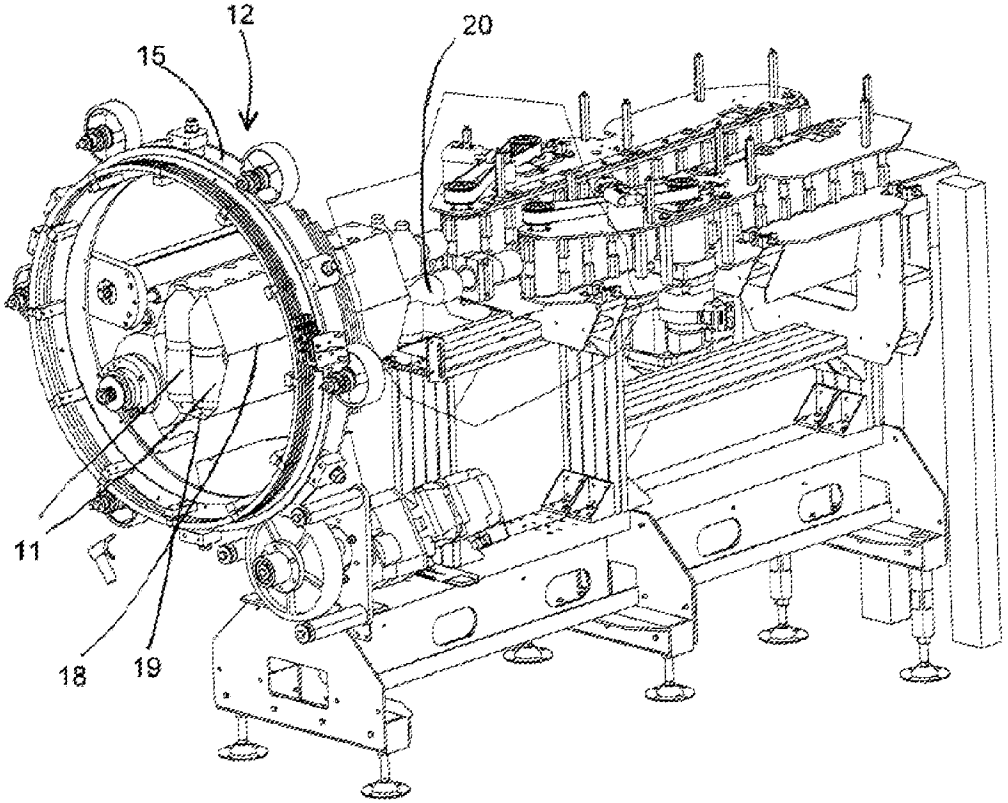
FIG. 1 is a schematic perspective view of a section of a packaging machine of products wherein the method according to the present invention is implemented.
Figure 2:
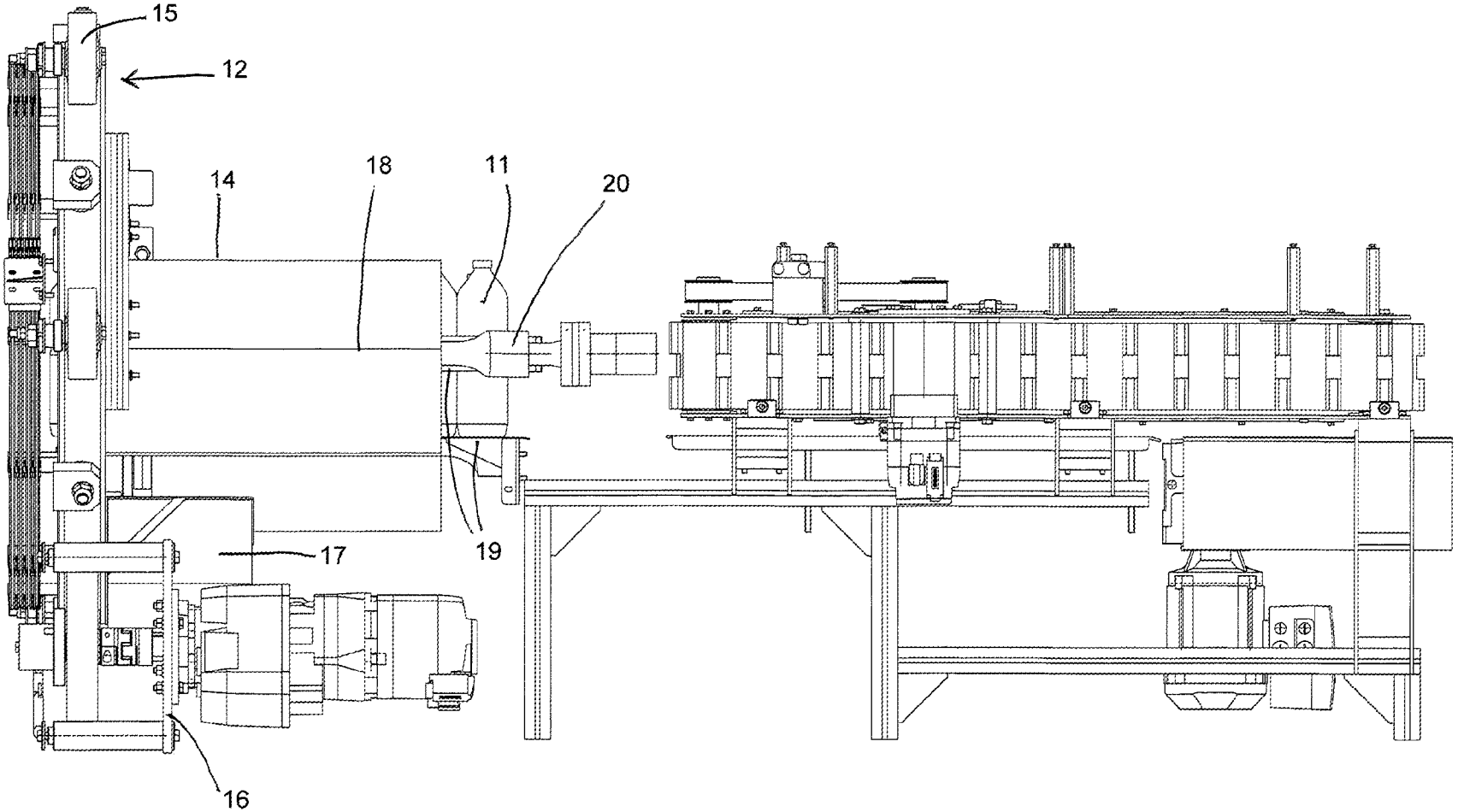
FIGS. 2 and 3 are respectively a raised side view and a plan view from above of the machine section shown previously in FIG. 1.
Figure 3:
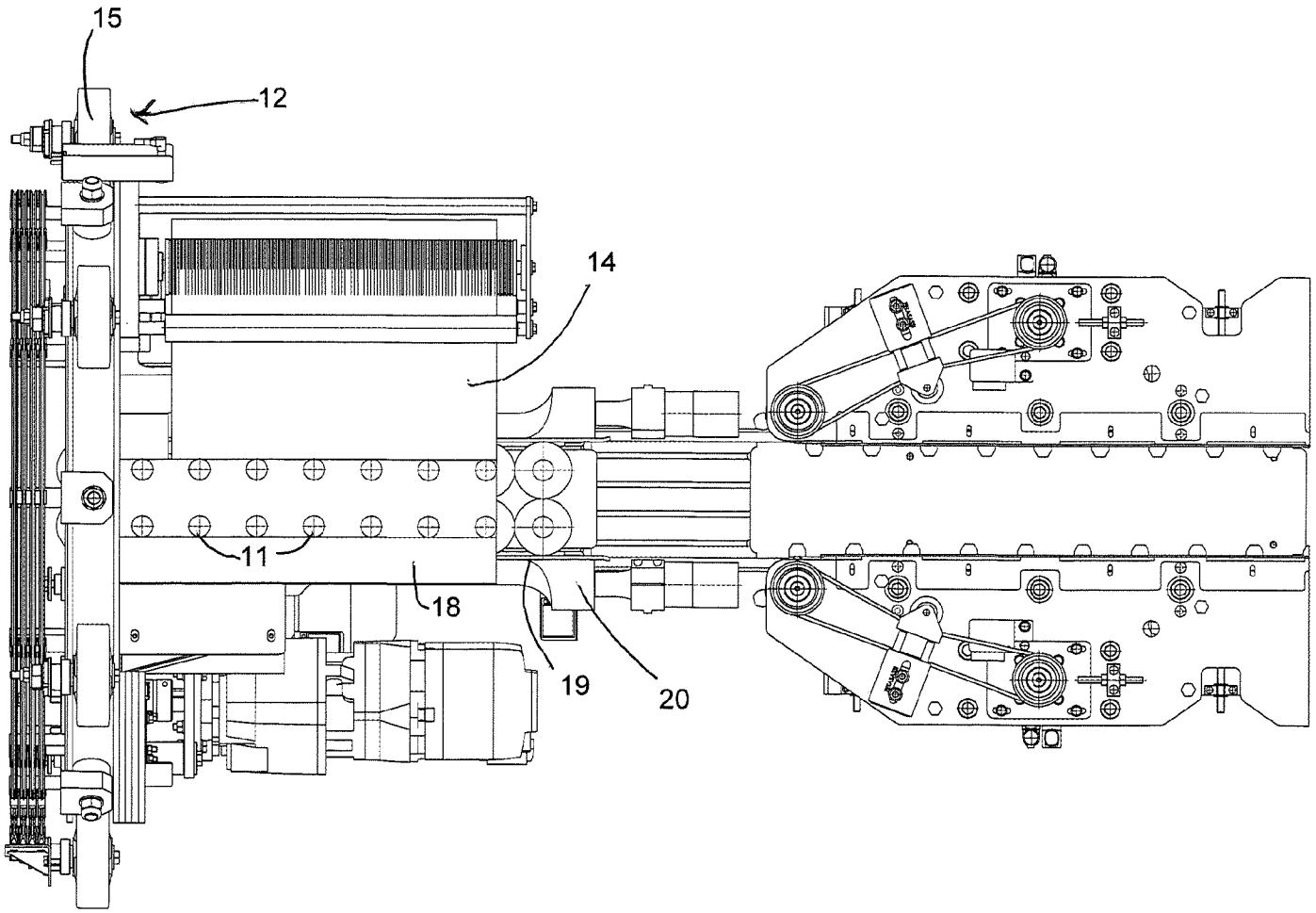

FIG. 1, for example, shows a first section of the packaging machine in which the products 11 are sorted in consecutive rows perfectly aligned. In particular, in this section, in the non-limiting but purely illustrative example, the machine is provided with a group suitable for arranging two rows of products 11 in the form of pairs of bottles paired with each other up to an inlet section of the wrapping unit 12 consisting of the winding ring 15.

Already in this section, guides with a minimum friction coefficient are positioned for guiding and/or supporting said products 1. In the figure, these guides comprise for example tubular elements 18 which come into contact exclusively with the products 11. The tubular elements 18 are positioned both laterally and as a support in the lower part of the products 11 and can have a circular section.

Furthermore, flat elements 19 are fixed to these tubular elements 18, for example made of sheet metal, which, in contact with the products 11 (the bottles), support them below and guide them laterally.

And again these guides, comprising tubular elements 18 having a circular section to which the flat elements 19 are fixed, are vibrated at ultrasonic frequency by means of piezoelectric motors 20 in order to reduce or almost eliminate the friction that is created between the products 11 and the guides themselves.

In the example shown, the products 11 already wrapped in a first stretch film 14 are also illustrated and the above-mentioned guides therefore support below and laterally guide the products 11 already wrapped in a first stretch film 14 (which however may not be present).

The subsequent passage within the winding ring 15 of the wrapping group 12 would therefore have a second stretch film above the first stretch film 14 containing the products 11.

An arrangement according to the present invention ensures that, unlike what is provided for in the presence of inert guides, where the friction that is generated between the film and the guides restrains the advancement of the products 11, this friction is eliminated.

Furthermore, with inert guides, a pressure is generated between the same products (necessary for advancing the products), which is harmful for the process.

According to this document, however, the friction between guides/film and/or products is greatly reduced which favours the advancement of the products that no longer undergo deformation due to the pressure.

A method according to the present invention achieves a significant improvement in containment/guiding systems for products such as containers to be arranged or already arranged in the film in a secondary packaging process with stretch film.

For the correct management of the packaging in general and in particular of the bundling in stretch film, a large part of the qualitative repeatability depends on the stable conditions of the contact friction between the film and/or advancing products and the guides. The reciprocal friction conditions between these elements is variable depending on various parameters, such as the process rate or the ratio between the winding angle and the advancement percentage of the products.

As the friction forces are generated by a contact force for a friction coefficient, it must be ensured that the latter tends towards zero, so that as the contact forces vary physiologically over time, the friction conditions remain tending towards "zero". The acoustic generation systems (ultrasounds) of the invention provide for mechanical/acoustic dimensioning in relation to a variation in the friction forces.

And this is what is achieved according to the invention set forth above where the desired effect has been obtained using a method and containment and conveyance systems produced in wrapping film by means of acoustic generation (ultrasounds). All this with the aim of bringing the guides into harmonic frequency so as to generate a surface vibration of the same, capable of zeroing the contact friction of anything on the guides.

The acoustic system used in a non-limiting way is a 35 KHz system coupled with an amplification booster associated with containment guides with geometric relationships having more than one harmonic and more than one nodal point. Depending on the reactivity requirements of the system, however, a variation in the application frequencies between 20 and 100 KHz can be provided for without altering the functional and claimed concepts of the invention.

In short, according to the present invention, a new method has been created and implemented for advancing products 11 arranged consecutively in at least one row (and possibly already wrapped in at least one stretch film) which are moved forwards into a packaging machine.

In the method of the invention, after a step for ordering the products 11 arranged consecutively in at least one continuous row, they are also moved forwards into the packaging machine.

As already mentioned, a further step can be provided for wrapping the products 11 arranged consecutively in at least one continuous row in at least one stretch film 14.

After packaging, the products 11 are naturally evacuated, arranged consecutively in at least one continuous row and wrapped in at least one stretch film 14.

The method is characterized in that in at least one of said steps, guides with a minimum friction coefficient are used for guiding and/or supporting the products 11 arranged consecutively in at least one continuous row and/or wrapped in the at least one stretch film 14.

The method typically provides for using acoustic generation systems (ultrasounds) as guides with a minimum friction coefficient for guiding and/or supporting the products 11, which are such as to generate a surface vibration of the guides, such as for example those previously described, capable of eliminating contact friction with the same with respect to the products alone or the products 11 already wrapped in the at least one stretch film 14.

The objective mentioned in the preamble of the description has thus been achieved.

The protection scope of the present invention is defined by the enclosed claims.

The invention claimed is:

1. A method for advancing products arranged consecutively in at least one row which are moved forwards into a packaging machine to be wrapped in at least one stretch film comprising the following steps:

ordering and advancing said products arranged consecutively in the at least one continuous row;

wrapping said products arranged consecutively in the at least one continuous row in said at least one stretch film;

evacuating said products arranged consecutively in the at least one continuous row and wrapped in said at least one stretch film;

wherein in at least one of said steps, guides with reduced friction are used for guiding and/or supporting said products arranged consecutively in the at least one continuous row and/or wrapped in said at least one stretch film;

wherein acoustic generation systems comprise the guides with reduced friction for guiding and/or supporting said products, which are configured to generate a surface vibration of said guides capable of reducing contact friction with the guides with respect to said products wrapped in said at least one stretch film.

2. The method according to claim 1, wherein said acoustic generation systems provide mechanical/acoustic dimensioning in relation to a variation in friction forces.

3. The method according to claim 2, wherein a 20 to 100 KHz system is used as said acoustic generation systems, coupled with an amplification booster associated with said guides.

4. The method according to claim 3, wherein a system is used as said acoustic generation systems.

5. The method according to claim 3, a system is used as said acoustic generation systems at 35 KHz.

6. The method according to claim 1, wherein piezoelectric motors are used as said acoustic generation systems.

7. The method according to claim 1, wherein said guides with reduced a friction are used below said products arranged consecutively in the at least one continuous row and/or wrapped in said at least one stretch film.

8. The method according to claim 1, wherein said guides with reduced friction are used laterally with respect to said products arranged consecutively in the at least one continuous row and/or wrapped in said at least one stretch film.

9. The method according to claim 1, wherein sheet metal plates are positioned between said guides with reduced friction and said products arranged consecutively in the at least one continuous row and wrapped in said at least one stretch film.

10. The method according to claim 1, wherein the guides with reduced friction comprise guides with a circular section.

* * * * *